United States Patent [19]

Daniel, Jr.

[11] 4,452,836

[45] Jun. 5, 1984

[54] CAP AND CLIP ASSEMBLY FOR ATTACHMENT TO ORNAMENT

[75] Inventor: James W. Daniel, Jr., Memphis, Tenn.

[73] Assignee: The Decor Noel Corporation, Memphis, Tenn.

[21] Appl. No.: 463,026

[22] Filed: Feb. 1, 1983

[51] Int. Cl.[3] ..... A47G 33/08

[52] U.S. Cl. ..... 428/11; 24/343; 248/360; 362/396; 362/806

[58] Field of Search ..... 24/343; 215/101, 347; 248/360; 362/396, 806; 428/11

[56] References Cited

U.S. PATENT DOCUMENTS

| | | | |
|---|---|---|---|
| 1,703,901 | 3/1929 | Schultz | 24/343 X |
| 2,059,653 | 2/1936 | Pretzfelder | 428/11 X |
| 2,269,589 | 9/1940 | Kaufman | 428/7 X |
| 2,512,129 | 9/1946 | Appleby | 428/11 X |
| 2,595,577 | 5/1952 | Harris | 24/343 X |
| 3,011,049 | 11/1961 | Kinghorn | 428/11 X |
| 3,123,514 | 3/1964 | Molinaro | 428/11 |
| 3,124,856 | 6/1962 | Fleminger | 428/11 X |
| 3,253,137 | 1/1964 | Richter | 362/248 X |
| 3,694,648 | 9/1972 | Yates | 428/11 X |
| 3,727,043 | 4/1973 | Wall | 362/806 X |
| 3,873,880 | 3/1975 | Riddell | 428/11 X |
| 3,940,521 | 2/1976 | Hack | 428/7 |
| 4,138,803 | 2/1979 | Sherlock | 47/67 |

FOREIGN PATENT DOCUMENTS 986606 3/1965 United Kingdom ..... 428/10

*Primary Examiner*—Henry F. Epstein
*Attorney, Agent, or Firm*—Finnegan, Henderson, Farabow, Garrett & Dunner

[57] ABSTRACT

An assembly for attachment to a hollow ornament such as a Christmas tree ball having a cap adapted to fit over the open end or neck of the ornament, and defining a cut-out area. A clip having an elongated central portion and outwardly extending end portions, stop means located at each end of the central portion and teeth means interposed between the stop means and the outwardly extending end portions also comprises part of the assembly. The cap and clip are comprised of a flexible and bendable plastic material which is electrically non-conductive and fire resistant. The central portion of the clip extends in U-shape configuration through the cut-out area of the cap and the outwardly extending end portions of the clip engage the interior part of the hollow ornament beneath its open end. The stops are positioned above the cap and are of sufficient length compared to the cut-out area to prevent the central portion of the clip from falling through the cut-out area into the interior of the ornament. The teeth are adjustably engaged with the edges of the cut-out area to vary the position of the outwardly extending end portions within the hollow ornament to maximize engagement with the interior part of the hollow ornament to thereby accommodate different configurations and sizes of ornaments.

5 Claims, 4 Drawing Figures

CAP AND CLIP ASSEMBLY FOR ATTACHMENT TO ORNAMENT

BACKGROUND OF THE INVENTION

1. Field Of The Invention

The present invention relates to ornamental devices, and, more particularly, to an assembly attachment for ornamental devices to facilitate hanging of the ornament and the placement of light bulbs therewithin for the purpose of illumination.

2. Description Of The Prior Art

The use of ornamental devices, such as Christmas tree ornaments, on festive occasions is well known in the art. Various types of clips and other attachments are available to hang these ornaments.

The insertion of light bulbs into hollow ornaments for illumination of the ornament is also known, and various means to secure the light bulb within the ornament are disclosed in the prior art.

SUMMARY OF THE INVENTION

The main object of the present invention is to provide a novel and improved assembly for attachment to an ornament to facilitate hanging and illumination of the ornament, the assembly being simple in construction, inexpensive to manufacture, and safe to use.

Another object of the invention is to provide such an assembly for attachment to an ornament which is designed so that most miniature lights can easily be inserted and held within the ornament, thus creating an ornament which is illuminated from the inside out.

A further object of the present invention is to construct the assembly for attachment to the ornament from a material such as nylon or another plastic which does not conduct electricity.

Yet another object of the invention is to construct the assembly for attachment to the ornament from a material such as nylon or another plastic which is fire resistant and which is capable of withstanding the heat generated from the lights inserted within the ornament.

It is yet another object of the invention to construct the assembly for attachment to the ornamental device such that it comprises relatively few parts and can be easily attached and detached from the ornament.

Additional objects and advantages of the invention will be set forth in part in the description which follows, and in part will be obvious from the description, or may be learned from practicing the invention. The objects and advantages of the invention may be realized and obtained by means of the instrumentalities and combinations particularly pointed out in the appended claims.

To achieve the foregoing objects and in accordance with the purposes of the invention as embodied and broadly described herein, an assembly for attachment to a hollow ornament having an open end is provided which comprises: a cap adapted to fit over the open end of the ornament, the cap defining a cut-out area; a clip having an elongated central portion and outwardly extending end portions, the clip further having stop means located at each end of the central portion and teeth means interposed between the stop means and the end portions; the cap and the clip being comprised of a flexible and bendable plastic material which is electrically non-conductive and fire resistant; the central portion of the clip extending in U-shape through the cut-out area of the cap and the end portions of the clip engaging the interior part of the hollow ornament beneath its open end, the stop means being located above the cap and of sufficient length compared to the cut-out area to prevent the central portion of the clip from falling through the cut-out area into the interior of the ornament; the teeth means being adjustably engaged with the edges of the cut-out area to vary the position of the end portions within the hollow ornament to maximize engagement with the interior part of the hollow ornament to thereby accommodate different configurations and sizes of ornaments.

Preferably, the cut-out area is cross-shaped, and comprises square-shaped portions at its center and at the end of each of its arms, with the width of the central portion of the clip being greater than the width of the arms of the cross and slightly greater than the width of the square-shaped ends, whereby the central portion of the clip, after it is pushed through the cross-shaped cut-out, is securely locked in the square-shaped ends.

In a preferred embodiment, at least one light can be inserted into the interior of the ornament by pushing it through the flexible and bendable plastic material defined in the cut-out area into the interior of the ornament, with the cap material returning to its original position after the light is inserted to thereby securely hold said at least one light in place within the interior of the ornament.

BRIEF DESCRIPTION OF THE DRAWINGS

The accompanying drawings, which are incorporated and constitutes a part of this Specification, illustrate a preferred embodiment of the invention and, together with the general description of the invention given above and the detailed description of the preferred embodiment given below, serve to explain the principles of the invention.

DESCRIPTION OF THE PREFERRED EMBODIMENT

Reference will now be made in detail to the present preferred embodiment of the invention as illustrated in the accompanying drawings.

Figure 1:
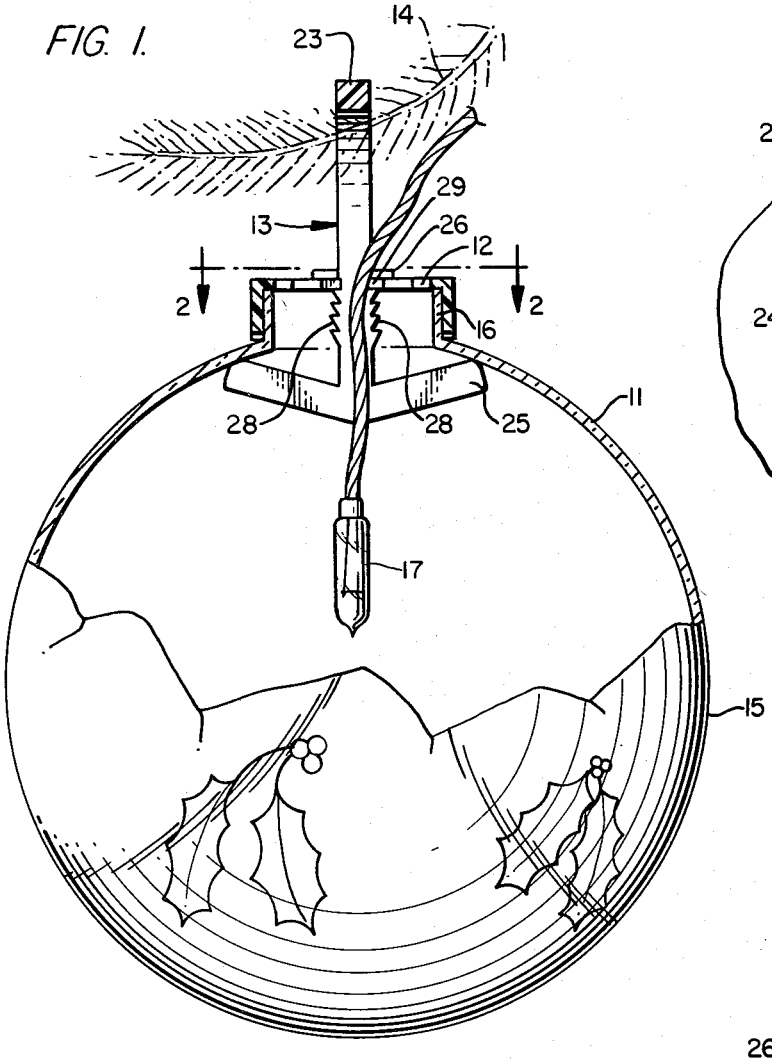
FIG. 1 is a generally sectional view of the cap and clip assembly in accordance with the invention, shown attached to an ornament which is hanging from a tree limb.

In FIG. 1 there is illustrated an ornament 11 hanging from limb 14 of a Christmas tree. The ornament 11 defines a hollow ball section 15 and a neck section 16.

In accordance with the invention, an assembly consisting of cap 12 and clip 13 is attached to ornament 11 for hanging it on limb 14 and for providing means to securely position one or a plurality of lights 17 within ornament 11 for the purpose of illuminating it from the inside out.

Figure 4:
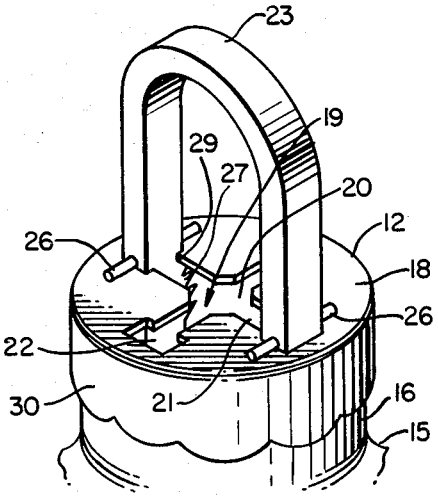
FIG. 4 is a perspective view of the cap and clip assembly attached to the neck of the ornament shown in FIG. 1.
Figure 3:
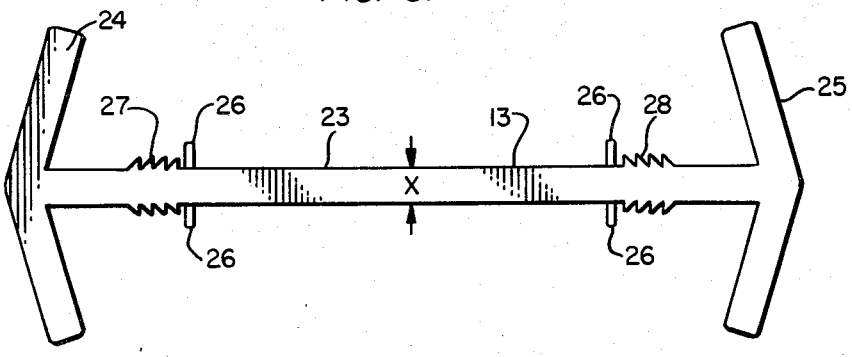
FIG. 3 is a plan view of the clip portion of the assembly, showing the clip stretched out end-to-end.

FIGS. 3 and 4 illustrate the details of cylindrical cap 12 which comprises a top portion 18 defining a cut-out area 19 which is preferably cross-shaped. The center portion 20 of cut-out area 19 is preferably a square-shaped portion. The ends 22 of each of arms 21 of the cross-shaped cut-out areas are rectangular or square-shaped and are of greater width than that of arms 21, for reasons that will be explained hereafter. The side portion 30 of cap 12 is integral with top portion 18, and may be "scalloped" for decorative purposes.

The clip portion of the assembly is shown in greater detail in FIG. 3 of the drawings, which shows the clip in laid-out position. Clip 13 comprises a central portion 23 and integral extending end portions 24 and 25 which are arrow-shaped. The clip 13 also defines four pins 26 which extend out from central portion 23. Teeth portions 27 and 28 are interposed between ends 24 and 25 and pins 26, as will be explained in more detail with respect to FIG. 1. The pins 26 and teeth portions 27 and 28 are also integral elements of the clip 13.

FIG. 4 shows the interconnection of the cap and clip in assembled form and attached to ornament 11. Both cap 12 and clip 13 are constructed of a plastic material such as nylon which does not conduct electricity. This is an important safety feature inasmuch as the device is used with electric lights. The plastic material is capable of withstanding the heat generated from the lights which may be utilized in conjunction with the invention and, in the event abnormal operation should result, is self-extinguishing should it catch fire. Moreover, the plastic material is very flexible and can be easily bent and forced without breaking. These characteristics of the plastic material used for the cap and clip assembly provides a device that is safe, sturdy, adjustable and inexpensive to manufacture.

In assembling the cap and clip, the clip 13 is inserted through the cut-out area 19 of cap 12 and pulled through. Even though the width X of clip 13 is greater than the width Y of arms 21, the flexible nature of the plastic material from which the cap and clip are produced allow the clip and its integral pins 26 to be easily pulled through the cut-out area 19.

Figure 2:
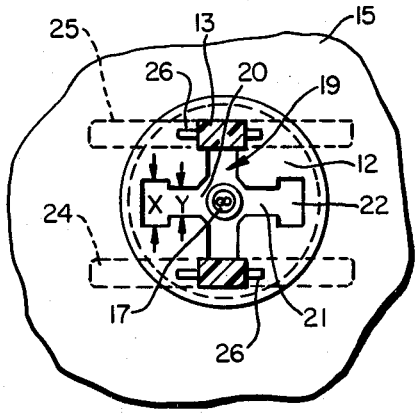
FIG. 2 is a sectional view of the cap and clip assembly taken along section lines 2—2 of FIG. 1.

In attaching the cap and clip assembly to an ornament, such as ball 11 of FIG. 1, the clip 13 is bent and inserted through the neck and into the interior of ball 11 as shown in FIGS. 1, 2 and 4. When the arrow-shaped ends 24 and 25 extend beyond the neck into ball 11, ends 24 and 25 extend out to engage the inner surface of ball 11, securing the cap 12 in place and preventing it from being easily pulled out. In this connection, the user can exert sufficient force to pull the cap and clip assembly from the ornament, but the normal weight exerted on the assembly, as for example when it is hanging on a tree limb, is not sufficient to dislodge the assembly.

Pins 26, as shown in FIGS. 1–4, extend beyond the Z dimensions of end portions 22 of cut-out area 19 and function as stops to prevent the central portion 23 of clip 11 from being pulled down through neck 16 into the interior of ball 11. The tooth portions 27 and 28 enable the clip to expand to fit various heights of necks which are available in ornaments, whereby the cap is fitted securely into various sizes and configurations of ornaments.

Thus, with respect to FIGS. 1 and 4, the position of clip 13 within neck 16 can be adjusted by changing the position at which teeth portions 27 and 28 lock into engagement with edges 29 of the cut-out area 19. This enables ends 24 and 25 of clip 13 to tightly engage the interior wall of ball 11, even though the neck sizes of ornaments vary. This adjustability feature enables the cap and clip assembly to be securely attached to various sizes and configurations of ornaments, with the tooth portions functioning to brace the cap 12 at its inner surface, which is a further safety advantage.

Another locking feature is provided by making the width X of clip 13 greater than the width Y of arm 19 and slightly greater than width Z of ends 22. Again, the flexible nature of the plastic material comprising the cap and clip enable the clip to be pushed through the cap cut-out and into ends 22 as shown in FIG. 4, and the relative widths discussed above cause clip 13 to be securely locked into position in ends 22. This provides yet a further safety feature of the invention. The user can, of course, exert sufficient force to dislodge the clip from the locked position in the cap.

As discussed above, the cut-out 19 defines a square portion 20 in the center. This enables the user to easily insert lights into the ornament as shown in FIG. 1. The flexible nature of the cap material causes it to be pushed downwards and enables a light to be pushed through the cut-out into the interior of ball 11 to provide illumination from the inside to the outside. Once the light is inserted, the flexible cap returns to its original level position, thus holding the light in place.

The normal pull on cap 12 is not sufficient to dislodge the light from the interior of the ball, and the light is thus securely and safely positioned therewithin. However, the user, by exerting sufficient force, can pull the light from the interior of the ball without breaking either the light or the cap and clip assembly. Moreover, the wires from the light and the light itself can touch the plastic cap and clip assembly without the danger of electrical shock or fire because of the characteristics of the material from which the cap and clip are constructed.

In accordance with the invention, either one or a plurality of lights 17 may be inserted into the interior of ball 11, or alternatively, the user may desire not to use any lights. The construction of the cap with its cross-shaped cut-out and flexible material enables one to put more than one light inside the ornament for extra illumination, and once a light has been inserted, another light may easily be inserted.

Although the invention has been illustrated and described with the use of miniature lights inserted within the ornament, it should be apparent to those skilled in the art that the invention has wider applicability and can be used with any size light, depending upon the size of the ornament being used. Moreover, the cap and clip assembly may be sold with a standard ornament or by itself, enabling the user to illuminate ornaments which he may already have.

After a light is inserted within the ornament, the ornament may be rotated 360° quite easily, depending upon the particular portion which the user wishes to display. Because of the plastic construction, breakage and/or injury will not occur if this is done.

The central portion 23 of clip 13, when assembled with cap 12 for attachment to bulb 11 as shown in FIGS. 1–3, assumes a U-shaped configuration which extends through the top of the ornament and may itself be used as a hook for hanging purposes. This U-shaped portion is flexible and hangs in the direct center of the cap, thereby ensuring that the ornament will hang and be centered properly. Alternatively, a conventional hook can be attached to U-shaped portion 23 for hanging purposes.

Although the preferred embodiment is described with respect to a cut-out 19 in the form of a cross and having squared central and end portions, other configurations are possible and can be substituted therefor without departing from the scope and spirit of the invention.

Additional advantages and modifications will readily occur to those skilled in the art. The invention in its broader aspects is therefore not limited to the specific details, representative apparatus, and illustrative examples shown and described. Accordingly, departures may be made from such details without departing from the spirit or scope of applicant's general inventive concept.

I claim:

1. An assembly for attachment to a hollow ornament having an open end, comprising:

a cap adapted to fit over the open end of the ornament, said cap defining a cut-out area;

a clip having an elongated central portion and outwardly extending end portions, said clip further having stop means located at each end of the central portion and teeth means interposed between said stop means and said end portions;

said cap and said clip being comprised of a flexible and bendable plastic material which is electrically non-conductive and fire resistant, the central portion of said clip extending in U-shape through the cut-out area of said cap and the end portions of the clip engaging the interior part of the hollow ornament beneath its open end, the stop means being located above the cap and of sufficient length compared to the cut-out area to prevent the central portion of the clip from falling through the cut-out area into the interior of the ornament, said teeth means being adjustably engaged with the edges of the cut-out area to vary the position of the end portions within the hollow ornament to maximize engagement with the interior part of the hollow ornament to thereby accommodate different configurations and sizes of ornaments.

2. The assembly of claim 1, wherein the cut-out area is cross-shaped.

3. The assembly of claim 1, wherein the cut-out area is cross-shaped and comprises square-shaped portions at its center and at the end of each of its arms, the width of the central portion of the clip being greater than the width of the arms of the cross and slightly greater than the width of the square-shaped portions at the ends of the arms, whereby the central portion of the clip, after it is pushed through the cross-shaped cut-out area, is securely locked in the square-shaped ends.

4. The assembly recited in claim 3, wherein at least one light can be inserted into the interior of the ornament by pushing it through the flexible and bendable plastic material defining the cut-out area into the interior of the ornament, with the cap material returning to its original position after the light is inserted to thereby securely hold said at least one light in place within the interior of the ornament.

5. The assembly as recited in claim 4, wherein the ornament is a ball and said open-end is the neck of the ball.

* * * * *